US010082250B2

(12) United States Patent
Jiang

(10) Patent No.: US 10,082,250 B2
(45) Date of Patent: Sep. 25, 2018

(54) LED TUBE LAMP

(71) Applicant: JIAXING SUPER LIGHTING ELECTRIC APPLIANCE CO., LTD, Zhejiang (CN)

(72) Inventor: Tao Jiang, Zhejiang (CN)

(73) Assignee: JIAXING SUPER LIGHTING ELECTRIC APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 15/087,092

(22) Filed: Mar. 31, 2016

(65) Prior Publication Data

US 2016/0215937 A1 Jul. 28, 2016

Related U.S. Application Data

(63) Continuation-in-part of application No. PCT/CN2015/096502, filed on Dec. 5, 2015.

(30) Foreign Application Priority Data

| | | |
|---|---|---|
| Dec. 5, 2014 | (CN) | 2014 1 0734425 |
| Feb. 12, 2015 | (CN) | 2015 1 0075925 |
| Mar. 27, 2015 | (CN) | 2015 1 0136796 |
| May 19, 2015 | (CN) | 2015 1 0259151 |
| Jun. 12, 2015 | (CN) | 2015 1 0324394 |

(Continued)

(51) Int. Cl.
*F21V 23/00* (2015.01)
*F21K 99/00* (2016.01)
(Continued)

(52) U.S. Cl.
CPC ..... *F21K 9/175* (2013.01); *F21K 9/27* (2016.08); *F21V 3/0418* (2013.01);
(Continued)

(58) Field of Classification Search
CPC ..... F21Y 2115/10; F21Y 2103/10; F21Y 2107/30
See application file for complete search history.

(56) References Cited

U.S. PATENT DOCUMENTS 2,454,049 A 11/1948 Floyd, Jr.
3,294,518 A 12/1966 Laseck et al.
(Continued)

FOREIGN PATENT DOCUMENTS

CN 200980183 A 11/2007
CN 201014273 Y 1/2008
(Continued)

*Primary Examiner* — Christopher Stanford
(74) *Attorney, Agent, or Firm* — Andrew M. Calderon; Roberts Mlotkowski Safran Cole & Calderon, P.C.

(57) ABSTRACT

An LED tube lamp including a glass lamp tube, an end cap disposed at one end of the glass lamp tube, a power supply provided inside the end cap, an LED light strip disposed inside the glass lamp tube with a plurality of LED light sources mounted on. The LED light strip has a bendable circuit sheet to electrically connect the LED light sources with the power supply. The glass lamp tube and the end cap are secured by a highly thermal conductive silicone gel. In addition, the end cap has at least one opening on surface to dissipate heat resulting from the power supply.

16 Claims, 17 Drawing Sheets

(30) Foreign Application Priority Data

| | | |
|---|---|---|
| Jun. 17, 2015 | (CN) | 2015 1 0338027 |
| Jun. 26, 2015 | (CN) | 2015 1 0373492 |
| Jul. 27, 2015 | (CN) | 2015 1 0448220 |
| Aug. 7, 2015 | (CN) | 2015 1 0482944 |
| Aug. 8, 2015 | (CN) | 2015 1 0483475 |
| Aug. 14, 2015 | (CN) | 2015 1 0499512 |
| Sep. 2, 2015 | (CN) | 2015 1 0555543 |
| Oct. 8, 2015 | (CN) | 2015 1 0645134 |
| Oct. 29, 2015 | (CN) | 2015 1 0716899 |
| Dec. 2, 2015 | (CN) | 2015 1 0868263 |

(51) Int. Cl.

| | |
|---|---|
| ***F21V 3/04*** | (2018.01) |
| ***F21V 23/02*** | (2006.01) |
| ***F21V 3/06*** | (2018.01) |
| ***F21V 3/10*** | (2018.01) |
| ***F21V 25/04*** | (2006.01) |
| ***F21V 7/00*** | (2006.01) |
| ***F21V 29/83*** | (2015.01) |
| ***F21V 15/015*** | (2006.01) |
| ***F21V 17/10*** | (2006.01) |
| ***F21V 19/00*** | (2006.01) |
| ***F21K 9/27*** | (2016.01) |
| *F21Y 103/10* | (2016.01) |
| *F21Y 115/10* | (2016.01) |

(52) U.S. Cl.

CPC ..... *F21V 3/0472* (2013.01); *F21V 3/061* (2018.02); *F21V 3/10* (2018.02); *F21V 7/005* (2013.01); *F21V 15/015* (2013.01); *F21V 17/101* (2013.01); *F21V 19/009* (2013.01); *F21V 23/02* (2013.01); *F21V 23/023* (2013.01); *F21V 25/04* (2013.01); *F21V 29/83* (2015.01); *F21Y 2103/10* (2016.08); *F21Y 2115/10* (2016.08)

(56) References Cited

U.S. PATENT DOCUMENTS

| | | | | |
|---|---|---|---|---|
| 4,059,324 | A | 11/1977 | Snyder et al. | |
| 4,156,265 | A | 5/1979 | Rose | |
| 4,647,399 | A | 3/1987 | Peters et al. | |
| 5,575,459 | A | 11/1996 | Anderson | |
| 5,921,660 | A | 7/1999 | Yu | |
| 5,964,518 | A | 10/1999 | Shen | |
| 6,118,072 | A | 9/2000 | Scott | |
| 6,127,783 | A | 10/2000 | Pashley et al. | |
| 6,186,649 | B1 | 2/2001 | Zou et al. | |
| 6,211,262 | B1 | 4/2001 | Mejiritski et al. | |
| 6,609,813 | B1 | 8/2003 | Showers et al. | |
| 6,796,680 | B1 | 9/2004 | Showers et al. | |
| 6,860,628 | B2 | 3/2005 | Robertson et al. | |
| 6,936,855 | B1 | 8/2005 | Harrah et al. | |
| 7,033,239 | B2 | 4/2006 | Cunkelman et al. | |
| 7,067,032 | B1 | 6/2006 | Bremont et al. | |
| 7,594,738 | B1 | 9/2009 | Lin et al. | |
| 8,360,599 | B2 | 1/2013 | Ivey et al. | |
| 8,456,075 | B2 | 6/2013 | Axelsson | |
| 8,579,463 | B2 | 11/2013 | Clough | |
| 9,322,531 | B2 | 4/2016 | Liang et al. | |
| D761,216 | S | 7/2016 | Jiang | |
| 9,447,929 | B2 | 9/2016 | Jiang | |
| 9,448,660 | B2 | 9/2016 | Seo et al. | |
| D768,891 | S | 10/2016 | Jiang et al. | |
| 9,618,168 | B1 | 4/2017 | Jiang et al. | |
| 9,864,438 | B2 | 1/2018 | Seo et al. | |
| 2002/0044456 | A1 | 4/2002 | Balestriero et al. | |
| 2003/0189829 | A1* | 10/2003 | Shimizu | F21L 4/00 362/240 |
| 2003/0231485 | A1 | 12/2003 | Chien | |
| 2004/0095078 | A1 | 5/2004 | Leong | |
| 2004/0189218 | A1 | 9/2004 | Leong et al. | |
| 2005/0128751 | A1 | 6/2005 | Roberge et al. | |
| 2005/0162850 | A1 | 7/2005 | Luk et al. | |
| 2005/0168123 | A1 | 8/2005 | Taniwa | |
| 2005/0207166 | A1 | 9/2005 | Kan et al. | |
| 2005/0213321 | A1 | 9/2005 | Lin | |
| 2006/0028837 | A1 | 2/2006 | Mrakovich et al. | |
| 2007/0001709 | A1 | 1/2007 | Shen | |
| 2007/0145915 | A1 | 6/2007 | Roberge et al. | |
| 2007/0210687 | A1 | 9/2007 | Axelsson | |
| 2007/0274084 | A1 | 11/2007 | Kan et al. | |
| 2008/0030981 | A1 | 2/2008 | Mrakovich et al. | |
| 2008/0192476 | A1 | 8/2008 | Hiratsuka | |
| 2008/0278941 | A1 | 11/2008 | Logan et al. | |
| 2008/0290814 | A1 | 11/2008 | Leong et al. | |
| 2009/0140271 | A1 | 6/2009 | Sah | |
| 2009/0159919 | A1 | 6/2009 | Simon et al. | |
| 2009/0161359 | A1 | 6/2009 | Siemiet et al. | |
| 2010/0085772 | A1 | 4/2010 | Song et al. | |
| 2010/0177532 | A1 | 7/2010 | Simon et al. | |
| 2010/0201269 | A1 | 8/2010 | Tzou et al. | |
| 2010/0220469 | A1 | 9/2010 | Ivey et al. | |
| 2010/0253226 | A1 | 10/2010 | Oki | |
| 2010/0277918 | A1 | 11/2010 | Chen et al. | |
| 2011/0038146 | A1 | 2/2011 | Chen | |
| 2011/0057572 | A1 | 3/2011 | Kit et al. | |
| 2011/0084608 | A1 | 4/2011 | Lin et al. | |
| 2011/0090684 | A1 | 4/2011 | Logan et al. | |
| 2011/0216538 | A1 | 9/2011 | Logan et al. | |
| 2011/0279063 | A1 | 11/2011 | Wang et al. | |
| 2012/0049684 | A1 | 3/2012 | Bodenstein et al. | |
| 2012/0069556 | A1 | 3/2012 | Bertram et al. | |
| 2012/0106157 | A1 | 5/2012 | Simon et al. | |
| 2012/0146503 | A1 | 6/2012 | Negley et al. | |
| 2012/0153873 | A1 | 6/2012 | Hayashi et al. | |
| 2012/0169968 | A1 | 7/2012 | Ishimori et al. | |
| 2012/0212951 | A1 | 8/2012 | Lai et al. | |
| 2012/0293991 | A1 | 11/2012 | Lin | |
| 2012/0319150 | A1 | 12/2012 | Shimomura et al. | |
| 2013/0021809 | A1 | 1/2013 | Dellian et al. | |
| 2013/0033881 | A1 | 2/2013 | Terazawa et al. | |
| 2013/0033888 | A1 | 2/2013 | Wel et al. | |
| 2013/0050998 | A1 | 2/2013 | Chu et al. | |
| 2013/0069538 | A1 | 3/2013 | So | |
| 2013/0094200 | A1 | 4/2013 | Dellian et al. | |
| 2013/0135852 | A1 | 5/2013 | Chan et al. | |
| 2013/0170196 | A1 | 7/2013 | Huang et al. | |
| 2013/0170245 | A1 | 7/2013 | Hong et al. | |
| 2013/0182425 | A1 | 7/2013 | Seki et al. | |
| 2013/0250565 | A1 | 9/2013 | Chiang et al. | |
| 2013/0256704 | A1 | 10/2013 | Hsiao et al. | |
| 2013/0258650 | A1* | 10/2013 | Sharrah | F21V 23/026 362/217.13 |
| 2013/0293098 | A1 | 11/2013 | Li et al. | |
| 2014/0071667 | A1 | 3/2014 | Hayashi et al. | |
| 2014/0153231 | A1 | 6/2014 | Bittmann | |
| 2014/0225519 | A1 | 8/2014 | Yu et al. | |
| 2014/0226320 | A1 | 8/2014 | Halliwell et al. | |
| 2015/0009688 | A1 | 1/2015 | Timmermans et al. | |
| 2015/0176770 | A1 | 6/2015 | Wilcox et al. | |
| 2015/0292681 | A1* | 10/2015 | Liang | F21V 23/02 362/222 |
| 2015/0327368 | A1 | 11/2015 | Su et al. | |
| 2016/0091147 | A1 | 3/2016 | Jiang et al. | |
| 2016/0091156 | A1 | 3/2016 | Li et al. | |
| 2016/0091179 | A1 | 3/2016 | Jiang et al. | |
| 2016/0102813 | A1 | 4/2016 | Ye et al. | |
| 2016/0178135 | A1 | 6/2016 | Xu et al. | |
| 2016/0178137 | A1 | 6/2016 | Jiang | |
| 2016/0178138 | A1 | 6/2016 | Jiang | |
| 2016/0198535 | A1 | 7/2016 | Ye et al. | |
| 2016/0212809 | A1 | 7/2016 | Xiong et al. | |
| 2016/0215936 | A1 | 7/2016 | Jiang | |
| 2016/0215937 | A1 | 7/2016 | Jiang | |
| 2016/0219658 | A1 | 7/2016 | Xiong et al. | |
| 2016/0219666 | A1 | 7/2016 | Xiong et al. | |
| 2016/0219672 | A1 | 7/2016 | Liu | |

(56) References Cited

U.S. PATENT DOCUMENTS

| | | | |
|---|---|---|---|
| 2016/0223180 | A1 | 8/2016 | Jiang |
| 2016/0223182 | A1 | 8/2016 | Jiang |
| 2016/0229621 | A1 | 8/2016 | Jiang |
| 2016/0255694 | A1 | 9/2016 | Jiang et al. |
| 2016/0255699 | A1 | 9/2016 | Ye et al. |
| 2016/0270163 | A1 | 9/2016 | Hu et al. |
| 2016/0270164 | A1 | 9/2016 | Xiong et al. |
| 2016/0270165 | A1 | 9/2016 | Xiong et al. |
| 2016/0270166 | A1 | 9/2016 | Xiong et al. |
| 2016/0270173 | A1 | 9/2016 | Xiong |
| 2016/0270184 | A1 | 9/2016 | Xiong et al. |
| 2016/0290566 | A1 | 10/2016 | Jiang et al. |
| 2016/0290567 | A1 | 10/2016 | Jiang et al. |
| 2016/0290568 | A1 | 10/2016 | Jiang et al. |
| 2016/0290569 | A1 | 10/2016 | Jiang et al. |
| 2016/0290570 | A1 | 10/2016 | Jiang et al. |
| 2016/0290598 | A1 | 10/2016 | Jiang |
| 2016/0290609 | A1 | 10/2016 | Jiang et al. |
| 2016/0295706 | A1 | 10/2016 | Jiang |
| 2016/0341414 | A1 | 11/2016 | Jiang |
| 2017/0038012 | A1 | 2/2017 | Jiang et al. |
| 2017/0038013 | A1 | 2/2017 | Liu et al. |
| 2017/0038014 | A1 | 2/2017 | Jiang et al. |
| 2017/0089521 | A1 | 3/2017 | Jiang |
| 2017/0130911 | A1 | 5/2017 | Li et al. |
| 2017/0159894 | A1 | 6/2017 | Jiang |
| 2017/0167664 | A1 | 6/2017 | Li et al. |
| 2017/0211753 | A1 | 7/2017 | Jiang et al. |
| 2017/0219169 | A1 | 8/2017 | Jiang |
| 2017/0290119 | A1 | 10/2017 | Xiong et al. |

FOREIGN PATENT DOCUMENTS

| | | | |
|---|---|---|---|
| CN | 101228393 | A | 7/2008 |
| CN | 201363601 | | 12/2009 |
| CN | 201437921 | | 4/2010 |
| CN | 102052652 | | 5/2011 |
| CN | 201866575 | U | 6/2011 |
| CN | 102116460 | | 7/2011 |
| CN | 102121578 | | 7/2011 |
| CN | 201954169 | U | 8/2011 |
| CN | 202120982 | U | 1/2012 |
| CN | 202125774 | | 1/2012 |
| CN | 102359697 | A | 2/2012 |
| CN | 202216003 | | 5/2012 |
| CN | 102518972 | | 6/2012 |
| CN | 102518972 | A | 6/2012 |
| CN | 202302841 | | 7/2012 |
| CN | 202392485 | U | 8/2012 |
| CN | 102720901 | | 10/2012 |
| CN | 102777788 | | 11/2012 |
| CN | 102889446 | | 1/2013 |
| CN | 202791824 | U | 3/2013 |
| CN | 103016984 | A | 4/2013 |
| CN | 103195999 | A | 7/2013 |
| CN | 203068187 | | 7/2013 |
| CN | 203240337 | | 10/2013 |
| CN | 203240337 | U | 10/2013 |
| CN | 203240362 | U | 10/2013 |
| CN | 203363984 | | 12/2013 |
| CN | 203384716 | U | 1/2014 |
| CN | 203413396 | U | 1/2014 |
| CN | 203453866 | U | 2/2014 |
| CN | 203464014 | | 3/2014 |
| CN | 103742875 | | 4/2014 |
| CN | 203517629 | U | 4/2014 |
| CN | 203549435 | | 4/2014 |
| CN | 203585876 | U | 5/2014 |
| CN | 203615157 | | 5/2014 |
| CN | 103851547 | | 6/2014 |
| CN | 103943752 | A | 7/2014 |
| CN | 203771102 | | 8/2014 |
| CN | 104033772 | | 9/2014 |
| CN | 203927469 | | 11/2014 |
| CN | 203927469 | U | 11/2014 |
| CN | 203963553 | U | 11/2014 |
| CN | 204042527 | | 12/2014 |
| CN | 204083927 | U | 1/2015 |
| CN | 204201535 | U | 3/2015 |
| CN | 204268162 | | 4/2015 |
| CN | 204268162 | U | 4/2015 |
| CN | 204300737 | | 4/2015 |
| CN | 104595765 | | 5/2015 |
| CN | 204420636 | | 6/2015 |
| CN | 104776332 | | 7/2015 |
| CN | 104832813 | A | 8/2015 |
| CN | 204573639 | | 8/2015 |
| EP | 3146803 | | 3/2017 |
| GB | 2519258 | | 4/2015 |
| GB | 2523275 | | 8/2015 |
| GB | 2531425 | | 4/2016 |
| JP | 2008117666 | | 5/2008 |
| JP | 3147313 | U | 12/2008 |
| JP | 2011061056 | | 3/2011 |
| JP | 2013254667 | A | 12/2013 |
| JP | 2014154479 | | 8/2014 |
| KR | 20120000551 | | 1/2012 |
| KR | 20120055349 | | 5/2012 |
| WO | 2009111098 | A2 | 9/2009 |
| WO | 2011132120 | | 10/2011 |
| WO | 2012129301 | | 9/2012 |
| WO | 2013125803 | | 8/2013 |
| WO | 2014001475 | | 1/2014 |
| WO | 2014117435 | | 8/2014 |
| WO | 2014118754 | | 8/2014 |
| WO | 2015036478 | | 3/2015 |
| WO | 2015081809 | | 6/2015 |
| WO | 2016086901 | | 6/2016 |

* cited by examiner

LED TUBE LAMP

CROSS-REFERENCE TO RELATED APPLICATIONS

This application is a continuation-in-part (CIP) application claiming benefit of PCT Application No. PCT/CN2015/096502, filed on 2015 Dec. 5, which claims priority to Chinese Patent Applications No. CN 201410734425.5 filed on 2014 Dec. 5; CN 201510075925.7 filed on 2015 Feb. 12; CN 201510136796.8 filed on 2015 Mar. 27; CN 201510259151.3 filed on 2015 May 19; CN 201510324394.0 filed on 2015 Jun. 12; CN 201510338027.6 filed on 2015 Jun. 17; CN 201510373492.3 filed on 2015 Jun. 26; CN 201510448220.5 filed on 2015 Jul. 27; CN 201510482944.1 filed on 2015 Aug. 7; CN 201510483475.5 filed on 2015 Aug. 8; CN 201510499512.1 filed on 2015 Aug. 14; CN 201510555543.4 filed on 2015 Sep. 2; CN 201510645134.3 filed on 2015 Oct. 8; CN 201510716899.1 filed on 2015 Oct. 29, and CN 201510868263.9 filed on 2015 Dec. 2, the disclosures of which are incorporated herein in their entirety by reference.

FIELD OF THE INVENTION

The present disclosure relates to illumination devices, and more particularly to an LED tube lamp and its components including the light sources, electronic components, and end caps.

BACKGROUND OF THE INVENTION

LED lighting technology is rapidly developing to replace traditional incandescent and fluorescent lightings. LED tube lamps are mercury-free in comparison with fluorescent tube lamps that need to be filled with inert gas and mercury. Thus, it is not surprising that LED tube lamps are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption; therefore, when taking into account all factors, they would typically be considered as a cost effective lighting option.

Typical LED tube lamps have a lamp tube, a circuit board disposed inside the lamp tube with light sources being mounted on the circuit board, and end caps accompanying a power supply provided at two ends of the lamp tube with the electricity from the power supply transmitting to the light sources through the circuit board. However, existing LED tube lamps have certain drawbacks.

First, the typical circuit board is rigid and allows the entire lamp tube to maintain a straight tube configuration when the lamp tube is partially ruptured or broken, and this gives the user a false impression that the LED tube lamp remains usable and is likely to cause the user to be electrically shocked upon handling or installation of the LED tube lamp.

Second, the rigid circuit board is typically electrically connected with the end caps by way of wire bonding, in which the wires may be easily damaged and even broken due to any move during manufacturing, transportation, and usage of the LED tube lamp and therefore may disable the LED tube lamp.

Third, the existing LED tube lamps are bad in heat dissipation, especially have problem in dissipating heat resulting from the power supply components inside the end caps. The heat resulting from the power supply components may cause a high temperature around end cap and therefore reduces life span of the adhesive and simultaneously disables the adhesion between the lamp tube and the end caps.

Accordingly, the present disclosure and its embodiments are herein provided.

SUMMARY OF THE INVENTION

It's specially noted that the present disclosure may actually include one or more inventions claimed currently or not yet claimed, and for avoiding confusion due to unnecessarily distinguishing between those possible inventions at the stage of preparing the specification, the possible plurality of inventions herein may be collectively referred to as "the (present) invention" herein.

Various embodiments are summarized in this section, and are described with respect to the "present invention," which terminology is used to describe certain presently disclosed embodiments, whether claimed or not, and is not necessarily an exhaustive description of all possible embodiments, but rather is merely a summary of certain embodiments. Certain of the embodiments described below as various aspects of the "present invention" can be combined in different manners to form an LED tube lamp or a portion thereof.

The present invention provides a novel LED tube lamp, and aspects thereof.

The present invention provides an LED tube lamp. According to one embodiment, the LED lamp includes a glass lamp tube, an end cap, a power supply, and an LED light strip. The end cap is disposed at one end of the glass lamp tube. The end cap includes a socket for connection with a power supply, and includes at least one opening on surface to dissipate heat resulting from the power supply. The power supply is provided inside the end cap and has a metal pin at one end, while the end cap has a hollow conductive pin to accommodate the metal pin of the power supply. The LED light strip is disposed inside the glass lamp tube with a plurality of LED light sources mounted on the LED light strip. The LED light strip has a bendable circuit sheet electrically connecting the LED light sources with the power supply. The length of the bendable circuit sheet is larger than the length of the glass lamp tube. The glass lamp tube and the end cap are secured by a highly thermal conductive silicone gel.

In some embodiments, the at least one opening may be adjacent to an edge of the end surface of the end cap.

In some embodiments, the at least one opening comprises openings arranged to form a circle or a partial circle.

In some embodiments, the at least one opening comprises openings arranged to form concentric circles or concentric partial circles.

In some embodiments, the at least one opening may be in a shape of arc, line or partial circle.

In some embodiments, at least one opening is located on an end surface of the end cap, and at least one opening is located on an outer circumferential surface of the end cap.

The present invention also provides an LED tube lamp, according to one embodiment, includes a glass lamp tube, two end caps with different sizes, a power supply, and an LED light strip. The two end caps are respectively disposed at one end of the glass lamp tube. At least one of the two end caps includes an electrically insulating tubular part sleeved with the end of the lamp tube, and at least one opening on surface to dissipate heat resulting from the power supply. The power supply is provided inside the end cap. The LED light strip is disposed inside the glass lamp tube with a plurality of LED light sources mounted on the LED light strip. The LED light strip has a bendable circuit sheet electrically connecting the LED light sources with the power supply. The length of the bendable circuit sheet is larger than the length of the glass lamp tube. The glass lamp tube and the end cap are secured by a highly thermal conductive silicone gel.

In some embodiments, the size of one end cap is 30%-80% of the size of the other end cap.

In some embodiments, the at least one opening is located on an end surface of the electrically insulating tubular part of the end cap.

In some embodiments, the at least one opening is adjacent to an edge of the end surface of the electrically insulating tubular part of the end cap.

In some embodiments, at least one opening is located on an end surface of the electrically insulating tubular part of the end cap, and at least one opening is located on an outer circumferential surface of the electrically insulating tubular part of the end cap.

The present invention also provides an LED tube lamp, according to one embodiment, includes a glass lamp tube, an end cap, a power supply, and an LED light strip. The end cap is disposed at one end of the glass lamp tube. The end cap includes a socket for connection with a power supply, and at least one opening on surface to dissipate heat resulting from the power supply. The power supply is provided inside the end cap and has a metal pin at one end, while the end cap has a hollow conductive pin to accommodate the metal pin of the power supply. The LED light strip is disposed inside the glass lamp tube with a plurality of LED light sources mounted on the LED light strip. The LED light strip electrically connects the LED light sources with the power supply.

In the above-mentioned embodiments, the at least one opening disposed on the surface of the end cap may help to dissipate heat resulting from the power supply by passing through the end cap such that the reliability of the LED tube lamp could be improved. While in some embodiments, the openings disposed on the surface of the end cap may not pass through the end cap for heat dissipation. In the embodiments using highly thermal conductive silicone gel to secure the glass lamp tube and the end cap, the at least one opening may also accelerate the solidification process of the highly thermal conductive gel.

DETAILED DESCRIPTION OF PREFERRED EMBODIMENTS

The present disclosure provides a novel LED tube lamp based on the glass made lamp tube to solve the abovementioned problems. The present disclosure will now be described in the following embodiments with reference to the drawings. The following descriptions of various embodiments of this invention are presented herein for purpose of illustration and giving examples only. It is not intended to be exhaustive or to be limited to the precise form disclosed. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

"Terms such as "about" or "approximately" may reflect sizes, orientations, or layouts that vary only in a small relative manner, and/or in a way that does not significantly alter the operation, functionality, or structure of certain elements. For example, a range from "about 0.1 to about 1" may encompass a range such as a 0% to 5% deviation around 0.1 and a 0% to 5% deviation around 1, especially if such deviation maintains the same effect as the listed range."

"Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein."

Figure 1:
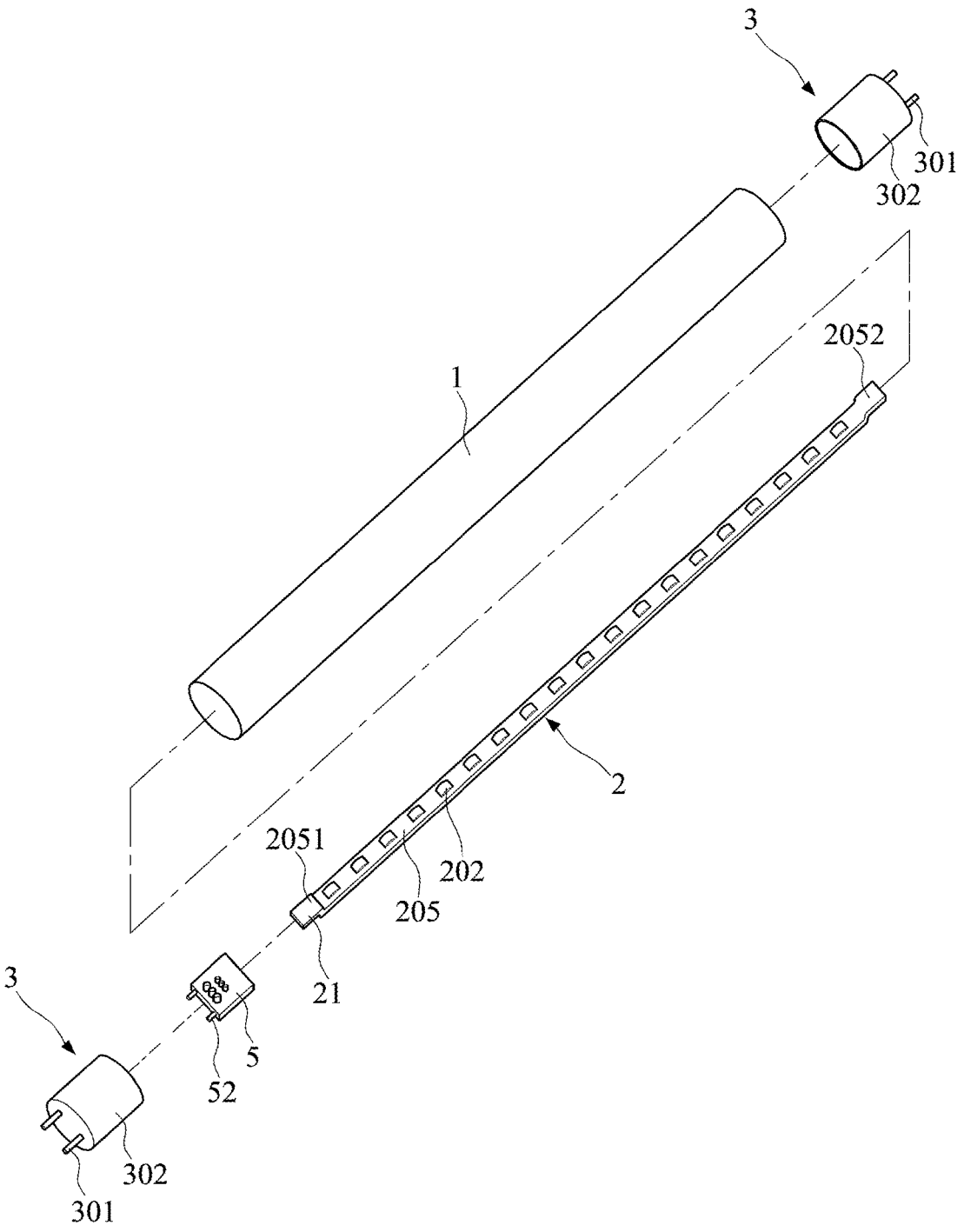
FIG. 1 is an exploded view schematically illustrating the LED tube lamp according to the first embodiment of the present invention.

Referring to FIG. 1, an LED tube lamp in accordance with a first embodiment of the present invention includes a glass lamp tube 1, two end caps 3 respectively disposed at two ends of the glass lamp tube 1, a power supply 5, and an LED light strip 2 disposed inside the glass lamp tube 1.

Figure 2:
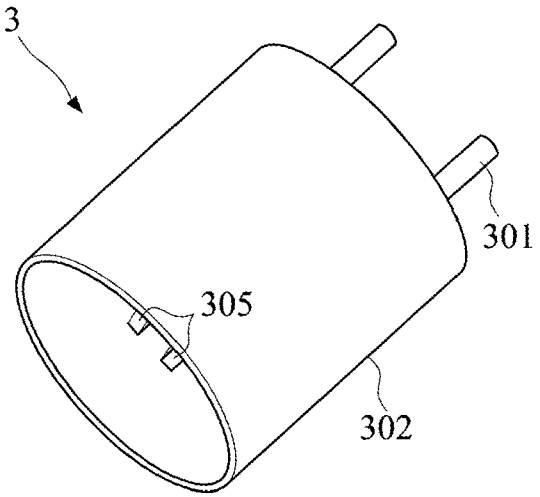
FIG. 2 is a perspective view schematically illustrating the end cap according to one embodiment of the present invention.
Figure 3:
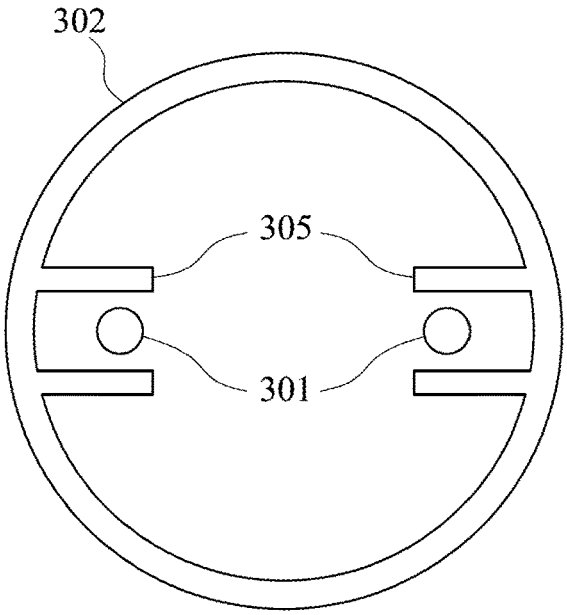
FIG. 3 is a side view schematically illustrating the end cap according to one embodiment of the present invention.

Referring to FIG. 1 to FIG. 3, the end cap 3 includes a socket 305 for being inserted with a power supply 5. The power supply 5 is provided inside the end cap 3 and can be fixed in the socket 305. As illustrated on FIGS. 2 and 3, the socket 305 is for being inserted with the power supply 5. The power supply 5 has a metal pin 52 at one end, while the end cap 3 has a hollow conductive pin 301 to accommodate the metal pin 52 of the power supply 5. In one embodiment, the electrically insulating tubular part 302 is not limited to being made of plastic or ceramic, any material that is not a good electrical conductor can be used. In some one embodiment, the end cap 3 may further include an electrically insulating tubular part 302. The socket has at least one insertion slot. An inserting direction of the insertion slot is substantially parallel to a longitudinal axis of the glass lamp tube so that the socket is integrally formed with the at least one end cap.

Figure 4:
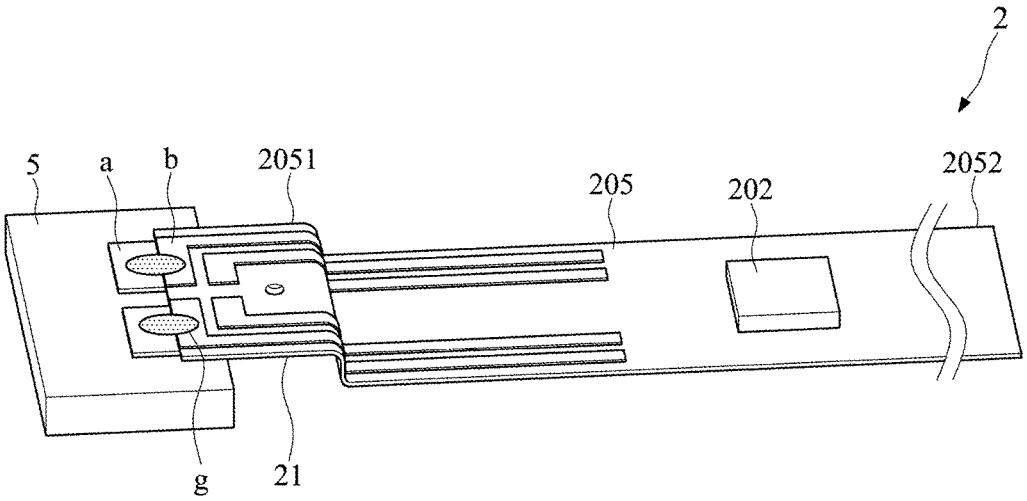
FIG. 4 is a perspective view schematically illustrating the soldering pad of the bendable circuit sheet of the LED light strip for soldering connection with the printed circuit board of the power supply of the LED tube lamp according to one embodiment of the present invention.

Referring to FIG. 1 and FIG. 4, the LED light strip 2 is disposed inside the glass lamp tube 1 with a plurality of LED light sources 202 mounted on the LED light strip 2. The LED light strip 2 has a bendable circuit sheet 205 electrically connecting the LED light sources 202 with the power supply 5. The length of the bendable circuit sheet 205 is larger than the length of the glass lamp tube 1. The glass lamp tube 1 and the end cap 3 are secured by a highly thermal conductive silicone gel. In one embodiment, the bendable circuit sheet 205 has a first end 2051 and a second end 2052 opposite to each other along the first direction, and at least the first end 2051 of the bendable circuit sheet 205 is bent away from the glass lamp tube 1 to form a freely extending end portion 21 along a longitudinal direction of the glass lamp tube 1. In some embodiments, if two power supplies 5 are adopted, then the second end 2052 might be bent away from the glass lamp tube 1 to form another freely extending end portion 21 along the longitudinal direction of the glass lamp tube 1. The freely extending end portion 21 is electrically connected to the power supply 5. Specifically, the power supply 5 has soldering pads "a" which are capable of being soldered with the soldering pads "b" of the freely extending end portion 21 by soldering material "g".

Figure 5:
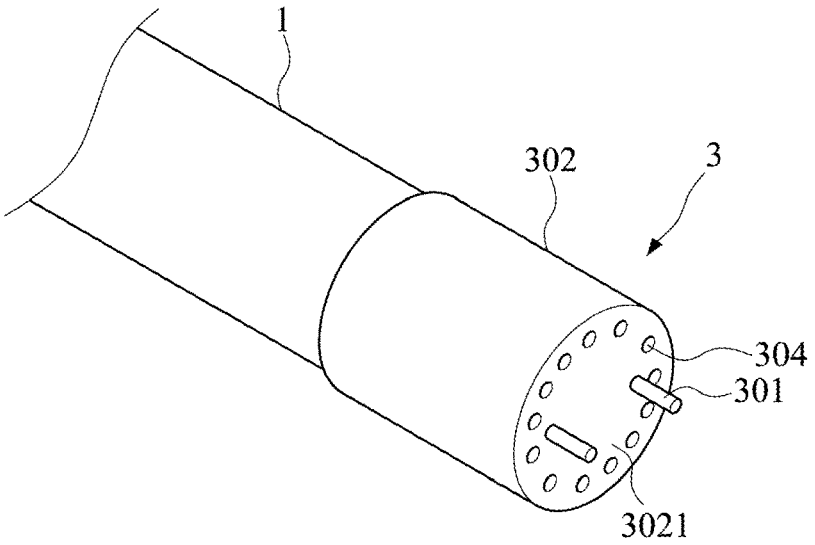
FIG. 5 is a perspective view schematically illustrating the openings of end cap of the LED tube lamp according to the first embodiment of the present invention which are arranged to form a circle.
Figure 6:
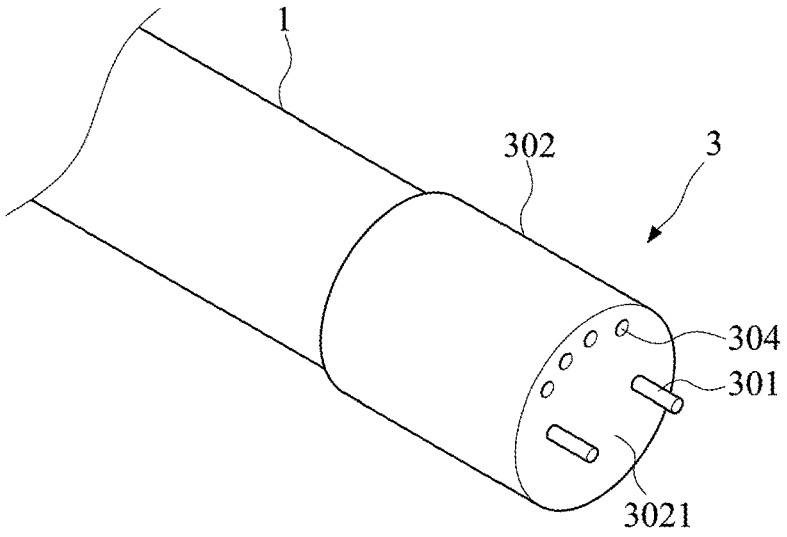
FIG. 6 is a perspective view schematically illustrating the openings of end cap of the LED tube lamp according to the first embodiment of the present invention which are arranged to form a partial circle.
Figure 7:
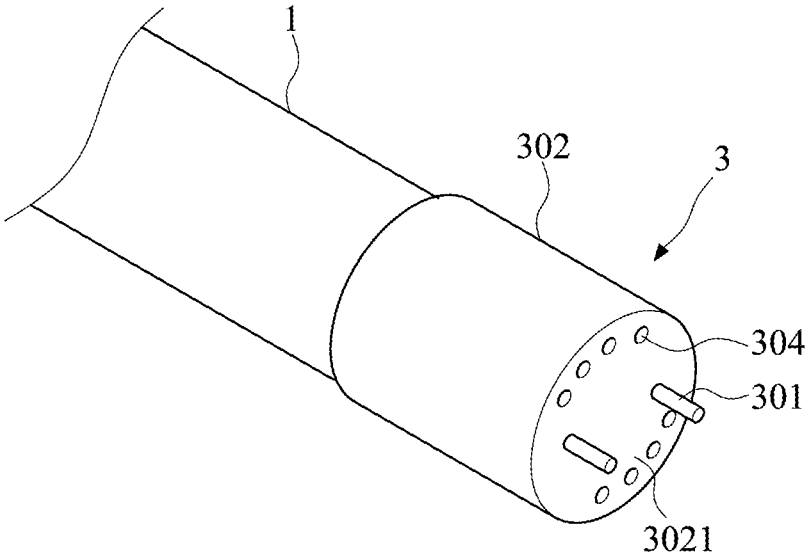
FIG. 7 is a perspective view schematically illustrating the openings of end cap of the LED tube lamp according to the first embodiment of the present invention which are arranged to form two partial circles.
Figure 8:
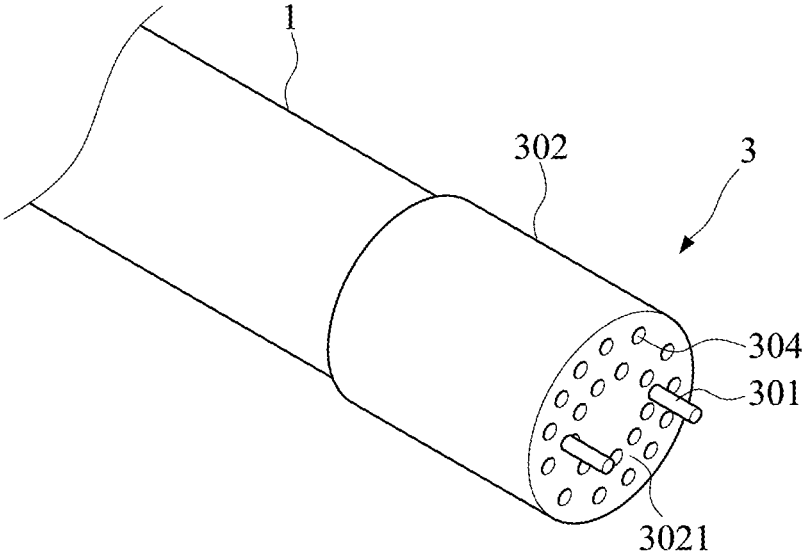
FIG. 8 is a perspective view schematically illustrating the openings of end cap of the LED tube lamp according to the first embodiment of the present invention which are arranged to form two concentric circles.
Figure 9:
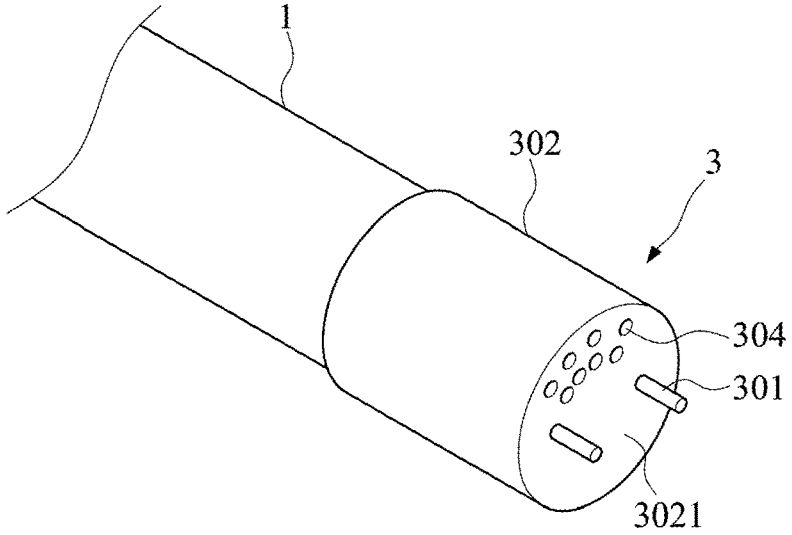
FIG. 9 is a perspective view schematically illustrating the openings of end cap of the LED tube lamp according to the first embodiment of the present invention which are arranged to form concentric partial circles.
Figure 10:
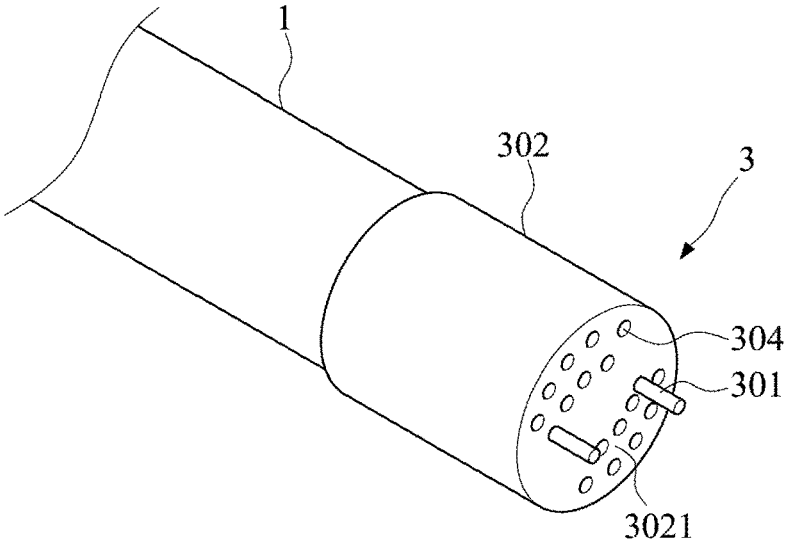
FIG. 10 is a perspective view schematically illustrating the openings of end cap of the LED tube lamp according to the first embodiment of the present invention which are arranged to form concentric partial circles.

Referring to FIG. 5 to FIG. 11, in order to dissipate heat resulting from the power supply 5, the end cap 3 has openings 304. In some embodiments, the openings 304 may be located on end surface 3021 of the electrically insulating tubular part 302 of the end cap 3. In some embodiments, the openings 304 may be adjacent to an edge of the end surface 3021 of the electrically insulating tubular part 302 of the end cap 3. In some embodiments, the openings 304 may be arranged to form a circle as shown in FIG. 5, or a partial circle as shown in FIG. 6 and FIG. 7. In some embodiments, the openings 304 may be arranged to form two concentric circles as shown in FIG. 8, or two concentric partial circles as shown in FIG. 9 and FIG. 10.

Figure 11:
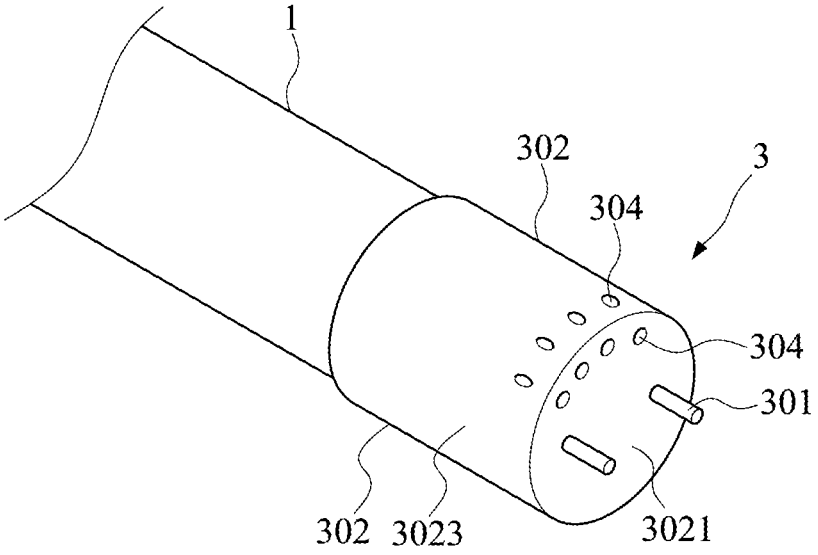
FIG. 11 is a perspective view schematically illustrating at least one opening is located on an end surface of the end cap, and at least one opening is located on an outer circumferential surface of the end cap of the LED tube lamp according to the first embodiment of the present invention.

Referring to FIG. 11, in some embodiments, at least one of the openings 304 is located on end surface 3021 of the electrically insulating tubular part 302 of the end cap 3, and at least one of the openings 304 is located on outer circumferential surface 3023 of the electrically insulating tubular part 302 of the end cap 3.

Figure 12:
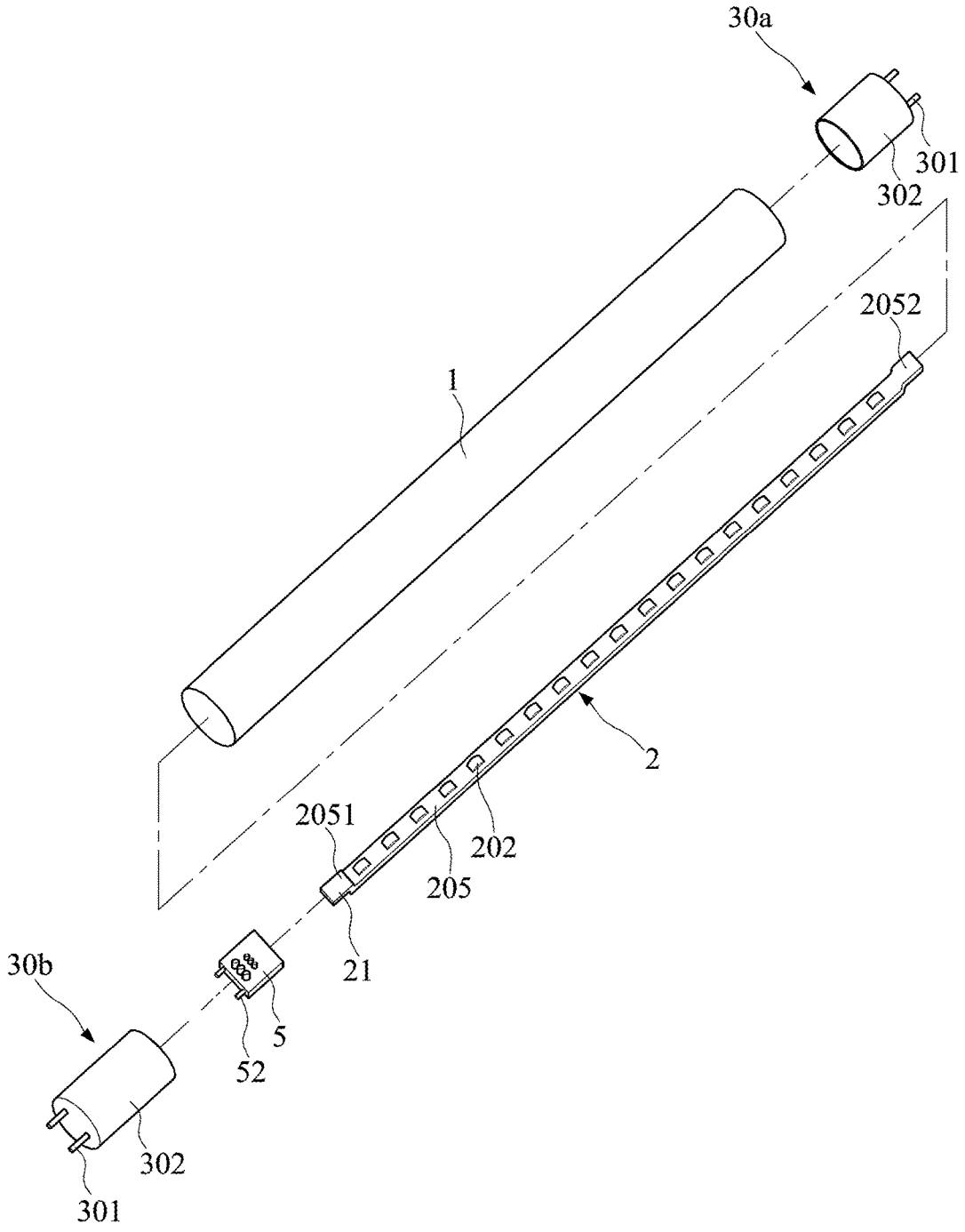
FIG. 12 is an exploded view schematically illustrating the LED tube lamp according to the second embodiment of the present invention.

Referring to FIG. 12, an LED tube lamp in accordance with a second embodiment of the present invention includes a glass lamp tube 1, end cap **30*a* and end cap 30*b*, a power supply 5, and an LED light strip 2 disposed inside the glass lamp tube 1**.

Referring to FIG. 12, the end caps **30*a* and 30*b* are different in size, in which the end cap 30*a* is smaller than the end cap 30*b*. The end caps 30*a* and 30*b* are respectively disposed at two ends of the glass lamp tube 1. The larger end cap 30*b* includes an electrically insulating tubular part 302. The electrically insulating tubular part 302 is sleeved with the end of the glass lamp tube 1. In one embodiment, the electrically insulating tubular part 302** is not limited to being made of plastic or ceramic, any material that is not a good electrical conductor can be used.

Referring to FIG. 12, the power supply 5 is fixed inside the larger end cap **30*b*. The power supply 5 has two metal pins 52 at one end, while the end cap 30*b* has two hollow conductive pins 301 to accommodate the metal pins 52 of the power supply 5. In some embodiments, even though only one power supply 5 is needed, the smaller end cap 30***a* may also have two dummy hollow conductive pins 301 for the purpose of fixing and installation.

Referring to FIG. 4 and FIG. 12, the LED light strip 2 is disposed inside the glass lamp tube 1 with a plurality of LED light sources 202 mounted on the LED light strip 2. The LED light strip 2 has a bendable circuit sheet 205 electrically connect the LED light sources 202 with the power supply 5. The length of the bendable circuit sheet 205 is larger than the length of the glass lamp tube 1. The glass lamp tube 1 and the end cap 3 are secured by a highly thermal conductive silicone gel. In one embodiment, the bendable circuit sheet 205 has a first end 2051 and a second end 2052 opposite to each other along the first direction, and at least the first end 2051 of the bendable circuit sheet 205 is bent away from the glass lamp tube 1 to form a freely extending end portion 21 along a longitudinal direction of the glass lamp tube 1. In some embodiments, if two power supplies 5 are adopted, then the second end 2052 might be bent away from the glass lamp tube 1 to form another freely extending end portion 21 along the longitudinal direction of the glass lamp tube 1. The freely extending end portion 21 is electrically connected to the power supply 5. Specifically, the power supply 5 has soldering pads "a" which are capable of being soldered with the soldering pads "b" of the freely extending end portion 21 by soldering material "g".

Figure 13:
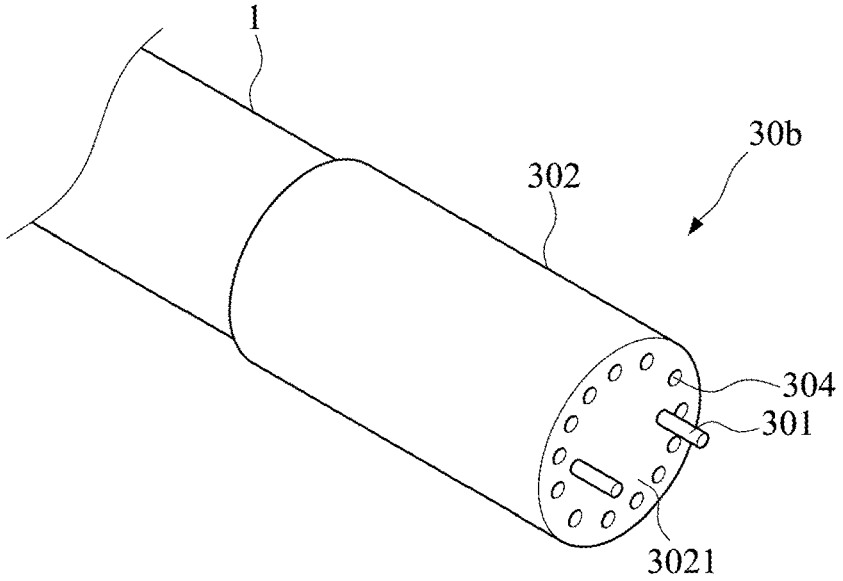
FIG. 13 is a perspective view schematically illustrating the openings of end cap of the LED tube lamp according to the second embodiment of the present invention which are arranged to form a circle.
Figure 14:
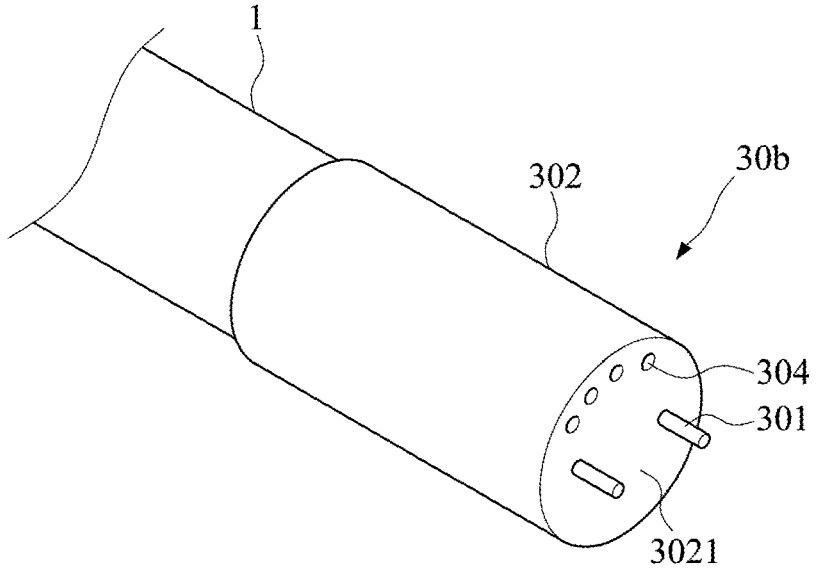
FIG. 14 is a perspective view schematically illustrating the openings of end cap of the LED tube lamp according to the second embodiment of the present invention which are arranged to form a partial circle.
Figure 15:
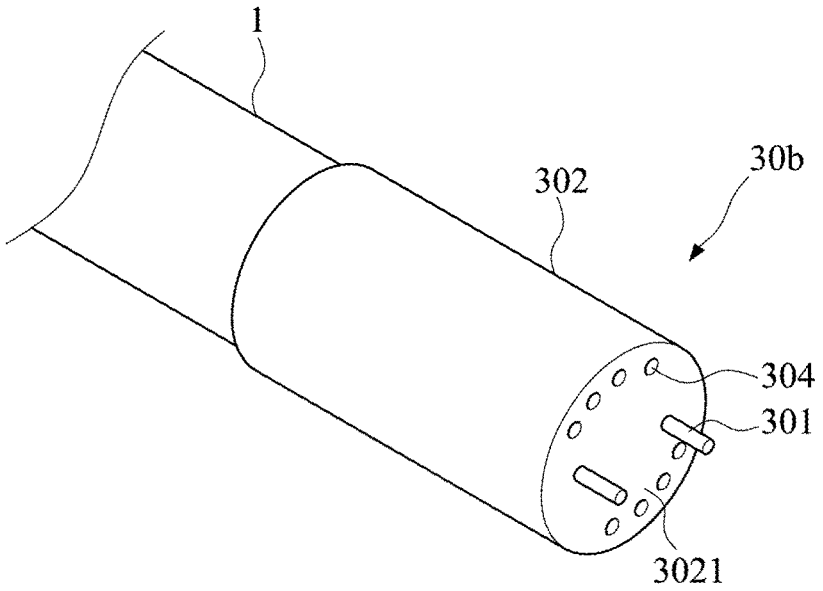
FIG. 15 is a perspective view schematically illustrating the openings of end cap of the LED tube lamp according to the second embodiment of the present invention which are arranged to form two partial circles.
Figure 16:
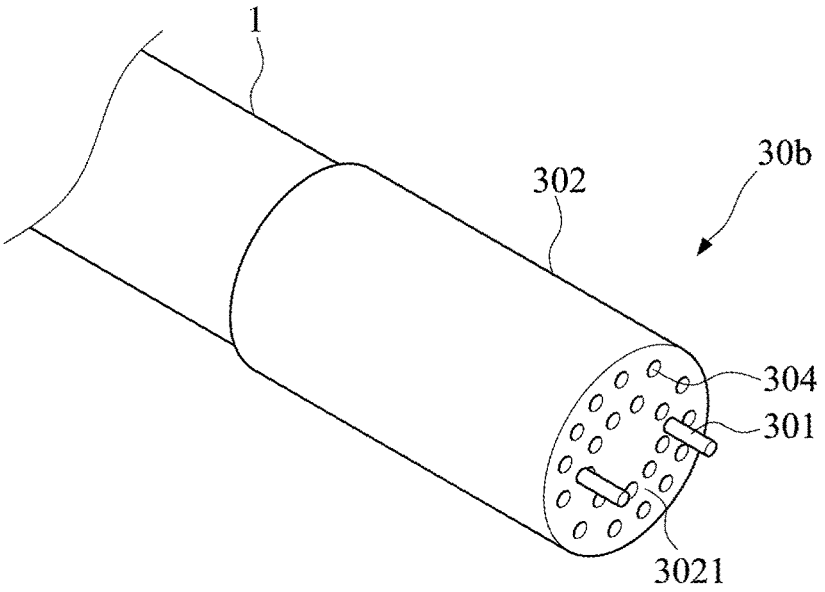
FIG. 16 is a perspective view schematically illustrating the openings of end cap of the LED tube lamp according to the second embodiment of the present invention which are arranged to form two concentric circles.
Figure 17:
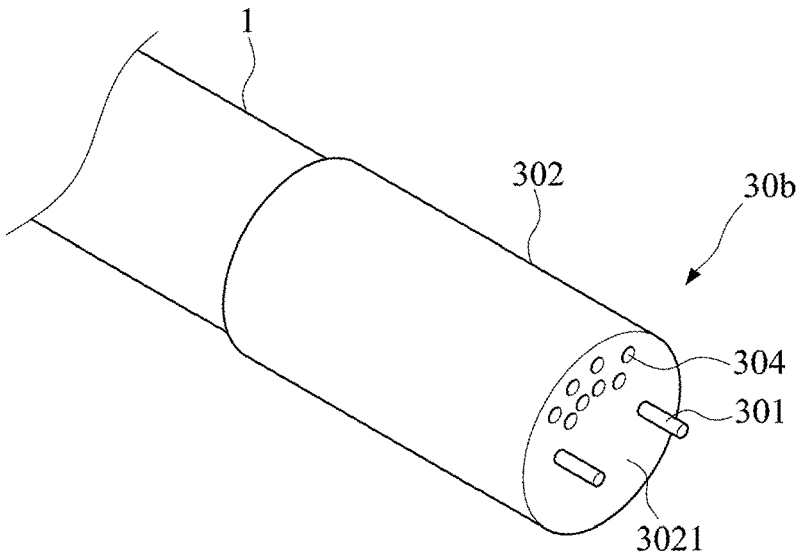
FIG. 17 is a perspective view schematically illustrating the openings of end cap of the LED tube lamp according to the second embodiment of the present invention which are arranged to form concentric partial circles.
Figure 18:
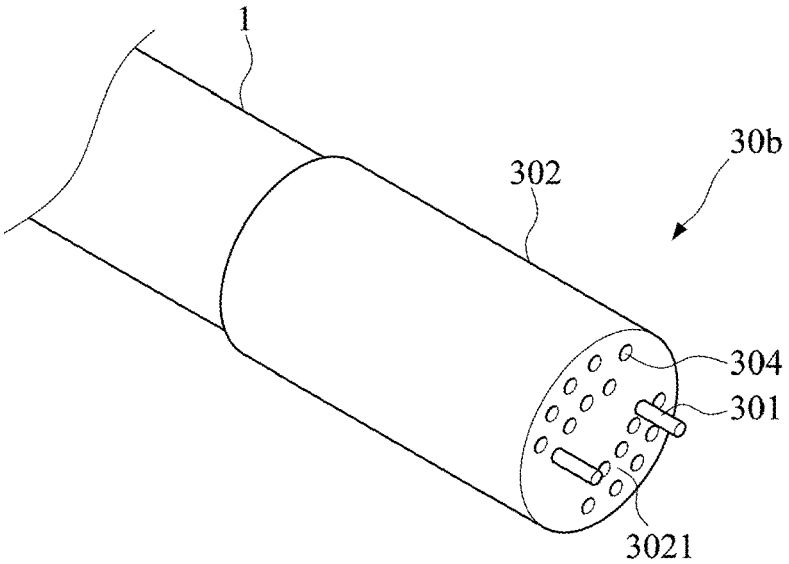
FIG. 18 is a perspective view schematically illustrating the openings of end cap of the LED tube lamp according to the second embodiment of the present invention which are arranged to form concentric partial circles.

Referring to FIG. 13 to FIG. 19, in order to dissipate heat resulting from the power supply 5, the larger end cap 30*b* has openings 304. In some embodiments, the openings 304 may be located on end surface 3021 of the electrically insulating tubular part 302. In some embodiments, the openings 304 may be adjacent to an edge of the end surface 3021 of the electrically insulating tubular part 302. In some embodiments, the openings 304 may be arranged to form a circle as shown in FIG. 13, or a partial circle as shown in FIG. 14 and FIG. 15. In some embodiments, the openings 304 may be arranged to form concentric circles as shown in FIG. 16, or concentric partial circles as shown in FIG. 17 and FIG. 18

Figure 19:
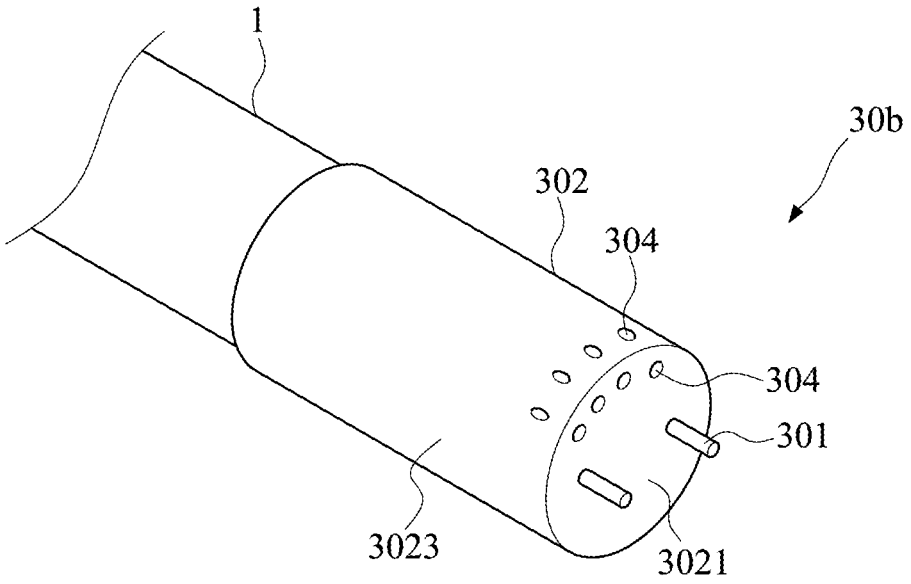
FIG. 19 is a perspective view schematically illustrating at least one opening is located on an end surface of the electrically insulating tubular part of the end cap of the LED tube lamp according to the second embodiment of the present invention, and at least one opening is located on an outer circumferential surface of the electrically insulating tubular part of the end cap.

Referring to FIG. 19, in some embodiments, at least one of the openings 304 is located on an end surface 3021 of the electrically insulating tubular part 302, and at least one of the openings 304 is located on an outer circumferential surface 3023 of the electrically insulating tubular part 302.

Figure 20:
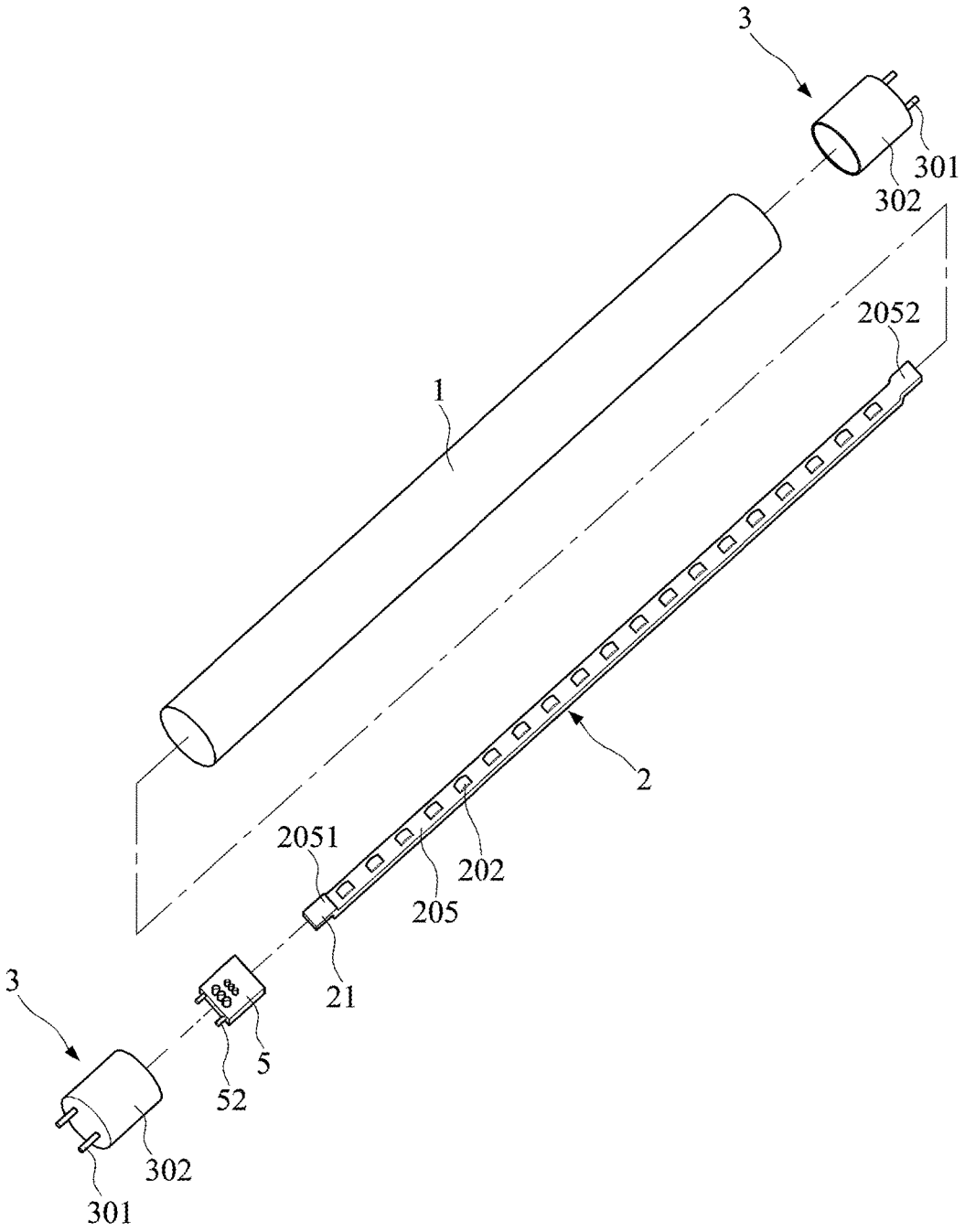
FIG. 20 is an exploded view schematically illustrating the LED tube lamp according to the third embodiment of the present invention.
Figure 21:
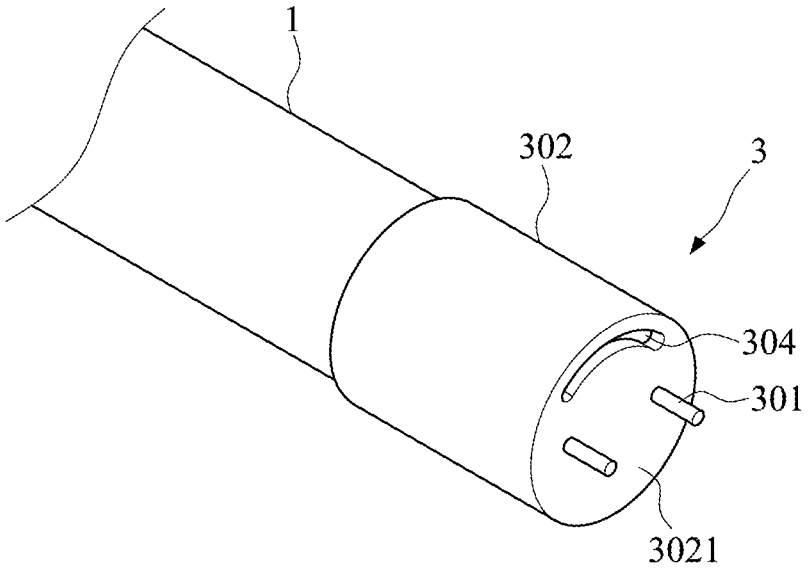
FIGS. 21-26 are perspective views schematically illustrating the at least one opening of end cap of the LED tube lamp according to the third embodiment of the present invention which is in a shape of arc.
Figure 22:
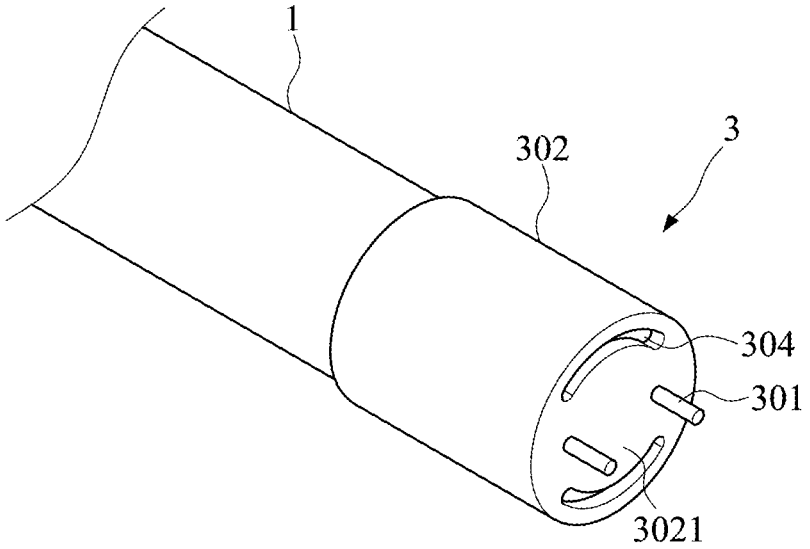
Figure 23:
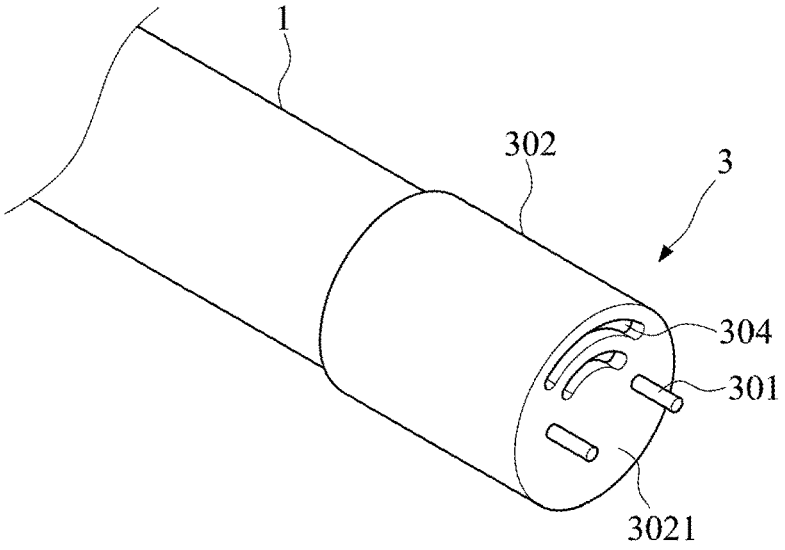
Figure 24:
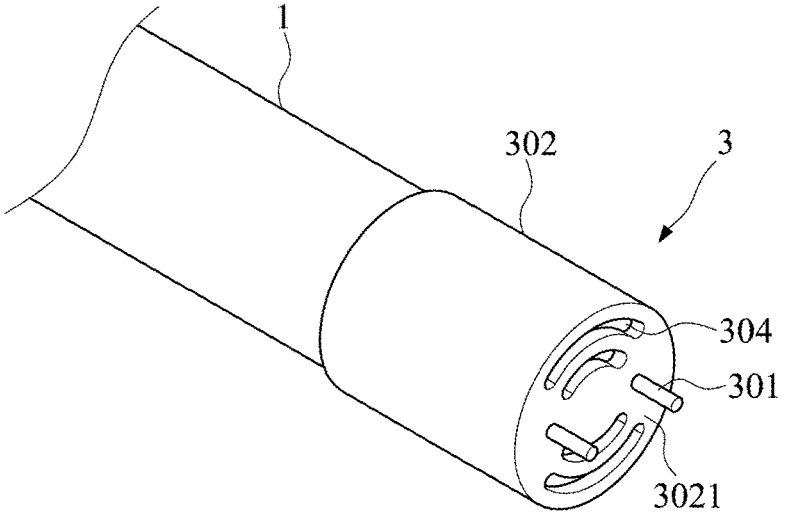
Figure 25:
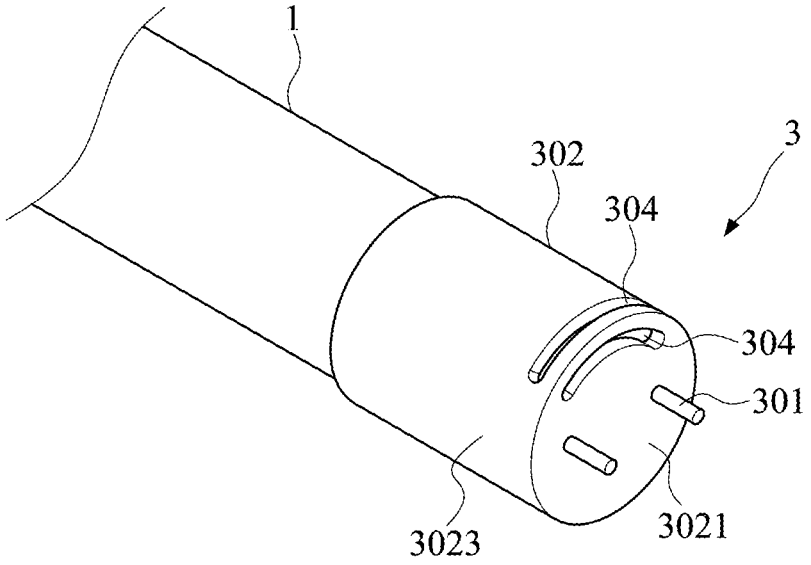
Figure 26:
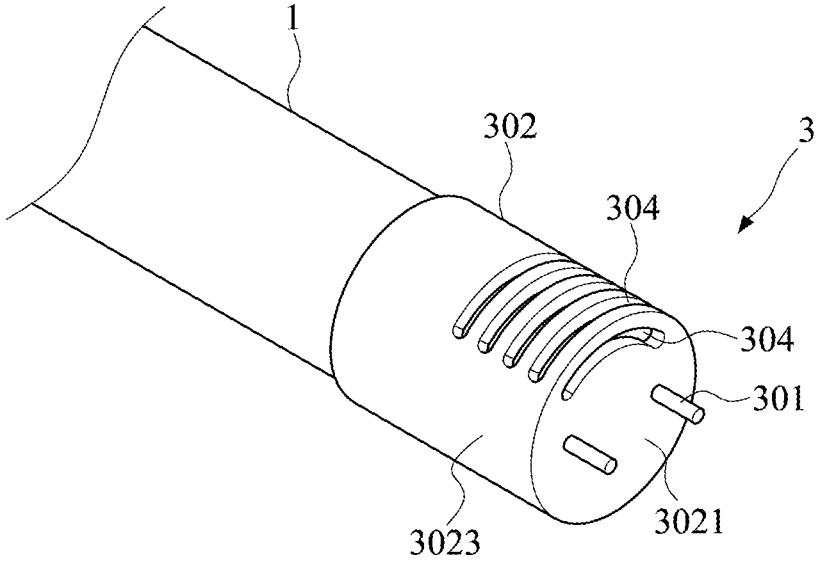

Referring to FIG. 20, an LED tube lamp in accordance with a third embodiment of the present invention includes a glass lamp tube 1, two end caps 3, a power supply 5, and an LED light strip 2.

Referring to FIG. 2, FIG. 3, and FIG. 20, the two end caps 3 are respectively disposed at one end of the glass lamp tube 1. At least one of the end caps 3 includes a socket 305 for connection with a power supply 5. The power supply 5 is provided inside the end cap 3 and can be fixed in the socket 305. The power supply 5 has a metal pin 52 at one end, while the end cap 3 has a hollow conductive pin 301 to accommodate the metal pin 52 of the power supply 5. In one embodiment, the electrically insulating tubular part 302 is not limited to being made of plastic or ceramic, any material that is not a good electrical conductor can be used.

Referring to FIG. 4 and FIG. 20, the LED light strip 2 is disposed inside the glass lamp tube 1 with a plurality of LED light sources 202 mounted on the LED light strip 2. The LED light strip 2 is electrically connected with the power supply 5. In some embodiments, the light strip 2 has a bendable circuit sheet 205. The length of the bendable circuit sheet 205 is larger than the length of the glass lamp tube 1. The bendable circuit sheet 205 has a first end 2051 and a second end 2052 opposite to each other along the first direction, and at least the first end 2051 of the bendable circuit sheet 205 is bent away from the glass lamp tube 1 to form a freely extending end portion 21 along a longitudinal direction of the glass lamp tube 1. In some embodiments, if two power supplies 5 are adopted, then the second end 2052 might be bent away from the glass lamp tube 1 to form another freely extending end portion 21 along the longitudinal direction of the glass lamp tube 1. The freely extending end portion 21 is electrically connected to the power supply 5. Specifically, the power supply 5 has soldering pads "a" which are capable of being soldered with the soldering pads "b" of the freely extending end portion 21 by soldering material "g". In some embodiments, the glass lamp tube 1 and the end caps 3 are secured by a highly thermal conductive silicone gel.

Figure 27:
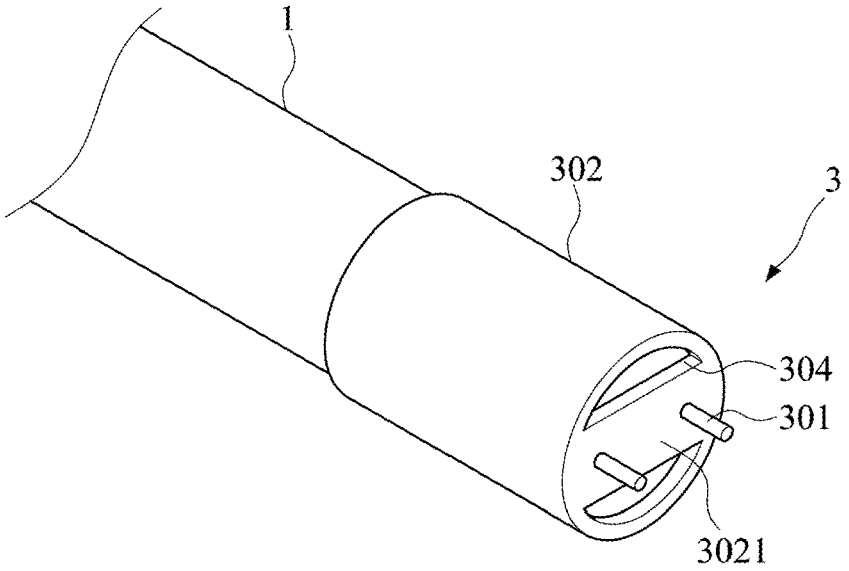
FIG. 27 is a perspective view schematically illustrating the openings of end cap of the LED tube lamp according to the third embodiment of the present invention which are in a shape of partial circle.
Figure 28:
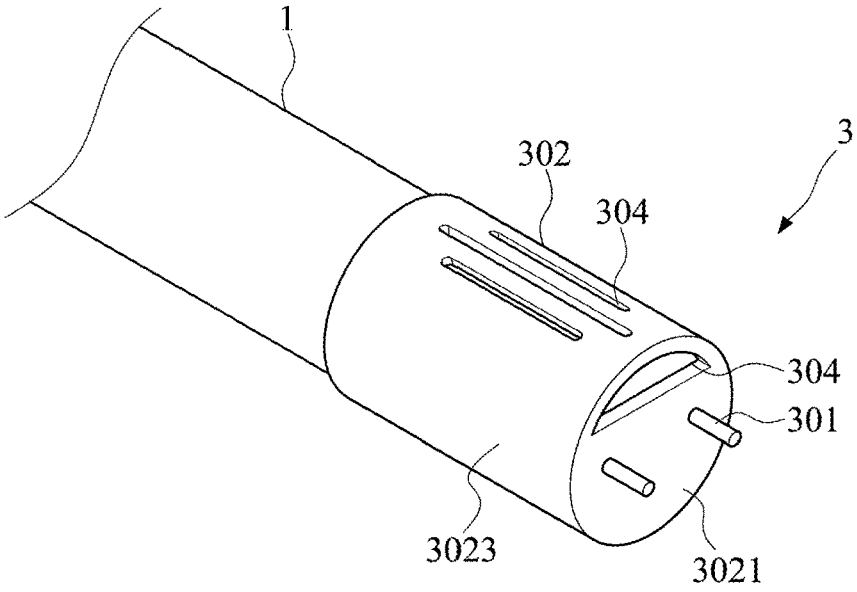
FIG. 28 is a perspective view schematically illustrating openings on the outer circumferential surface of the electrically insulating tubular part of the end cap of the LED tube lamp according to the third embodiment of the present invention may be in a shape of line, and at least one opening on the end surface of the electrically insulating tubular part of end cap is in a shape of partial circle.

In the above-mentioned embodiments, the shape of opening 304 is not limited to be a circle. The openings 304 can be designed to be in a shape of arc as shown in FIG. 21 to FIG. 26, or in a shape of partial circle as shown in FIG. 27. In some embodiments, as shown in FIG. 28, the openings 304 on the outer circumferential surface 3023 of the electrically insulating tubular part 302 may be in a shape of line, and the opening 304 on the end surface 3021 of the electrically insulating tubular part 302 is in a shape of partial circle.

In the above-mentioned embodiments, the openings 304 disposed on the surface of the end cap 3 may help to dissipate heat resulting from the power supply 5 by passing through the end cap 3 such that the reliability of the LED tube lamp could be improved. While in some embodiments, the openings 304 disposed on the surface of the end cap 3 may not pass through the end cap 3 for heat dissipation. In those embodiments using highly thermal conductive silicone gel to secure the glass lamp tube 1 and the end caps 3, the openings 304 may also accelerate the solidification process of the melted highly thermal conductive gel.

The above-mentioned features of the present invention can be accomplished in any combination to improve the LED tube lamp, and the above embodiments are described by way of example only. The present invention is not herein limited, and many variations are possible without departing from the spirit of the present invention and the scope as defined in the appended claims.

What is claimed is:

1. An LED tube lamp, comprising:

a glass lamp tube;

two end caps, each of the end caps disposed at one end of the glass lamp tube, wherein at least one of the end caps comprises a socket, and at least one opening on surface to dissipate heat;

a power supply provided inside the end cap, wherein the power supply has a metal pin at one end, the end cap has a hollow conductive pin to accommodate the metal pin of the power supply, and the socket is for being inserted with the power supply;

an LED light strip disposed inside the glass lamp tube with a plurality of LED light sources mounted on the LED light strip;

wherein the LED light strip has bendable, substantially planar circuit sheet electrically connecting the LED light sources with the power supply via a bent portion of the circuit sheet, the length of the bendable circuit sheet is larger than the length of the glass lamp tube, and the glass lamp tube and the end cap are secured by a thermal conductive silicone gel.

2. The LED tube lamp of claim 1, wherein the at least one opening on surface is to dissipate heat resulting from the power supply.

3. The LED tube lamp of claim 1, wherein the at least one opening is located on an end surface of the end cap.

4. The LED tube lamp of claim 3, wherein the at least one opening is adjacent to an edge of the end surface of the end cap.

5. The LED tube lamp of claim 3, wherein the end cap comprises at least three of the openings arranged to form a circle or a partial circle.

6. The LED tube lamp of claim 3, wherein the end cap comprises at least three of the openings arranged to form concentric circles or concentric partial circles.

7. The LED tube lamp of claim 1, wherein at least one opening is located on an end surface of the end cap, and at least one opening is located on an outer circumferential surface of the end cap.

8. The LED tube lamp of claim 1, wherein the at least one opening is located on an outer circumferential surface of the end cap.

9. An LED tube lamp, comprising:

a glass lamp tube;

two end caps with different sizes respectively disposed at two ends of the glass lamp tube, wherein at least one of the two end caps comprises an electrically insulating tubular part sleeved with the end of the lamp tube, and at least one opening on surface to dissipate heat;

a power supply provided inside the end cap;

an LED light strip disposed inside the glass lamp tube with a plurality of LED light sources mounted on the LED light strip;

wherein the LED light strip has bendable, substantially planar circuit sheet electrically connecting the LED light sources with the power supply via a bent portion of the circuit sheet, the length of the bendable circuit sheet is larger than the length of the glass lamp tube, and the glass lamp tube and the end cap are secured by a thermal conductive silicone gel.

10. The LED tube lamp of claim 9, wherein the at least one opening on surface is to dissipate heat resulting from the power supply.

11. The LED tube lamp of claim 9, wherein the at least one opening is located on an end surface of the electrically insulating tubular part.

12. The LED tube lamp of claim 11, wherein the at least one opening is adjacent to an edge of the end surface of the electrically insulating tubular part.

13. The LED tube lamp of claim 11, wherein the end cap comprises at least three of the openings arranged to form a circle or a partial circle.

14. The LED tube lamp of claim 11, wherein the end cap comprises at least three of the openings arranged to form concentric circles or concentric partial circles.

15. The LED tube lamp of claim 9, wherein at least one opening is located on an end surface of the electrically insulating tubular part, and at least one opening is located on an outer circumferential surface of the electrically insulating tubular part.

16. The LED tube lamp of claim 9, wherein the at least one opening is located on an outer circumferential surface of the electrically insulating tubular part.

* * * * *